US010041764B2

(12) United States Patent
Ooi

(10) Patent No.: US 10,041,764 B2
(45) Date of Patent: Aug. 7, 2018

(54) SENSOR SYSTEM AND METHOD FOR SENSING MOTION

(71) Applicant: Han Shyone Ooi, Houston, TX (US)

(72) Inventor: Han Shyone Ooi, Houston, TX (US)

( * ) Notice: Subject to any disclaimer, the term of this patent is extended or adjusted under 35 U.S.C. 154(b) by 0 days.

(21) Appl. No.: 15/398,754

(22) Filed: Jan. 5, 2017

(65) Prior Publication Data

US 2017/0307332 A1 Oct. 26, 2017

Related U.S. Application Data

(60) Provisional application No. 62/276,841, filed on Jan. 9, 2016, provisional application No. 62/310,089, filed on Mar. 18, 2016.

(51) Int. Cl.

| | |
|---|---|
| ***F41A 17/00*** | (2006.01) |
| ***F41G 3/12*** | (2006.01) |
| ***F41A 9/53*** | (2006.01) |
| ***F41A 17/06*** | (2006.01) |
| ***F41G 3/06*** | (2006.01) |

(52) U.S. Cl.

CPC ..... *F41G 3/12* (2013.01); *F41A 9/53* (2013.01); *F41A 17/06* (2013.01); *F41G 3/06* (2013.01)

(58) Field of Classification Search

CPC ..... F41G 3/12; F41G 3/06; F41A 9/53; F41A 17/06

USPC ..... 42/1.01, 70.01

See application file for complete search history.

(56) References Cited

U.S. PATENT DOCUMENTS 6,386,028 B2 * 5/2002 Kolbe ..... F41A 31/02 73/167

7,669,356 B2 * 3/2010 Joannes ..... F41A 19/01 42/1.01

(Continued)

FOREIGN PATENT DOCUMENTS

| | | |
|---|---|---|
| CN | 203217500 | 9/2013 |
| CN | 104415524 | 3/2015 |

(Continued)

OTHER PUBLICATIONS

Yocto-3D-USB Acceleration, tilt and orientation sensor; Nov. 16, 2015; http://www.yoctopuce.com/EN/products/usb-position-sensors/yocto-3d.

*Primary Examiner* — Samir Abdosh

(74) *Attorney, Agent, or Firm* — Bennet K. Langlotz; Langlotz Patent & Trademark Works, Inc.

(57) ABSTRACT

A sensor system for a firearm is disclosed. The sensor system contains a body, a mounting facility adapted to mount the body to the firearm, a first accelerometer connected to the body operable to generate a first acceleration signal based on detected acceleration of the body, a second accelerometer connected to the body operable to generate a second acceleration signal based on detected acceleration of the body, the first accelerometer operable for detection of accelerations within a first range between a first lower limit and a first upper limit, the second accelerometer operable for detection of accelerations within a second range between a second lower limit and a second upper limit, the first lower limit being less than the second lower limit, and the first upper limit being less than the second upper limit, such that at least portions of the first range and the second range do not overlap.

14 Claims, 8 Drawing Sheets

(56) References Cited

U.S. PATENT DOCUMENTS 8,176,667 B2 * 5/2012 Kamal ..... F41C 23/22 42/1.01
8,353,121 B2 * 1/2013 Clark ..... F41A 19/01 42/1.01
8,418,391 B2 * 4/2013 Kemmerer ..... F41A 17/066 42/70.05
8,668,496 B2 3/2014 Nolen
8,733,006 B2 * 5/2014 Williams ..... F41A 17/063 42/1.01
8,887,430 B2 11/2014 Wichner
9,126,094 B1 9/2015 Davis
9,151,564 B1 * 10/2015 Baxter ..... F41A 33/00
9,180,365 B2 11/2015 Torre et al.
2001/0015090 A1 * 8/2001 Kolbe ..... F41A 31/02 73/35.01
2005/0188583 A1 * 9/2005 Jackson ..... F41A 17/06 42/70.11
2009/0253103 A1 * 10/2009 Hogan, Jr. ..... F41A 9/61 434/24
2009/0277065 A1 * 11/2009 Clark ..... F41A 19/01 42/1.03
2009/0298590 A1 12/2009 Marks et al.
2011/0126622 A1 * 6/2011 Turner ..... F41A 17/08 73/514.01
2011/0162245 A1 * 7/2011 Kamal ..... F41A 19/01 42/1.01
2011/0207089 A1 8/2011 Lagettie
2011/0252684 A1 * 10/2011 Ufer ..... F41A 19/01 42/1.03
2012/0015332 A1 * 1/2012 Stutz ..... F41G 3/26 434/19
2012/0297654 A1 * 11/2012 Williams ..... F41A 17/063 42/1.01
2013/0019510 A1 * 1/2013 Kemmerer ..... F41A 17/066 42/1.01
2013/0019512 A1 * 1/2013 Kemmerer ..... F41A 17/066 42/70.05
2013/0125441 A1 * 5/2013 Westwood ..... F41A 17/02 42/70.05
2013/0225288 A1 8/2013 Levin
2014/0028635 A1 1/2014 Krah
2014/0190051 A1 * 7/2014 Wichner ..... G08B 21/182 42/1.05
2014/0366419 A1 * 12/2014 Allan ..... F41A 17/06 42/70.06
2015/0253109 A1 * 9/2015 Wichner ..... F41A 17/12 434/19
2015/0369554 A1 * 12/2015 Kramer ..... F41A 17/063 386/227
2016/0169627 A1 * 6/2016 Northrup ..... F41G 3/2633 434/22
2017/0074618 A1 * 3/2017 Wichner ..... F41A 17/12

FOREIGN PATENT DOCUMENTS

WO 2008025973 3/2008
WO 2014145079 9/2014
WO 2016115554 7/2016

* cited by examiner

SENSOR SYSTEM AND METHOD FOR SENSING MOTION

CROSS-REFERENCE TO RELATED APPLICATION

This application claims the benefit of U.S. Provisional Application No. 62/276,841, filed on Jan. 9, 2016, and claims the benefit of U.S. Provisional Application No. 62/310,089, filed on Mar. 18, 2016, which are incorporated herein by reference in their entirety.

FIELD OF THE INVENTION

The present invention relates to a sensor system. More particularly, the present invention relates to a sensor system for sensing motion of a firearm and/or other devices.

BACKGROUND OF THE INVENTION

According to the prior art, a number of devices are used for firearms training. Some known devices depend upon the use of lasers and laser detecting targets to provide feedback to shooters. However, the laser based systems are unreliable and cannot distinguish between life firing or dry firing of the firearm.

Some known device incorporate the use of a single accelerometer to provide feedback to the shooter. However, due to limitations in the operating bandwidth, the single accelerometer training devices provide very limited information to the user about the condition of the firearm and/or the user's shooting technique. For example, the known single accelerometer training devices are not sensitive enough to register small vibrations such as target rifle triggers while being able to register high-G vibrations such as full pistol recoil.

In view of the above, a need exists for an improved device and method for sensing motion of a firearm and/or other devices.

In the following description, like reference numbers are used to identify like elements. Furthermore, the drawings are intended to illustrate major features of exemplary embodiments in a diagrammatic manner. The drawings are not intended to depict every feature of every implementation nor relative dimensions of the depicted elements, and are not drawn to scale.

DESCRIPTION OF THE CURRENT EMBODIMENT

In the following description, numerous specific details are set forth to clearly describe various specific embodiments disclosed herein. One skilled in the art, however, will understand that the presently claimed invention may be practiced without all of the specific details discussed below. In other instances, well known features have not been described so as not to obscure the invention.

A sensor system presently disclosed may be used in the field of firearms training, operation, benchmarking, fitting, and maintenance. The sensor system presently disclosed may comprise a wirelessly enabled motion sensing apparatus which monitors a shooter's before and after trigger pull hand motions to determine areas for improvement. The sensor system presently disclosed may be used as a tool to fit the gun to the shooter by measuring peak recoil impulse and movement. The sensor system presently disclosed may allow gunsmiths and gun builders to tune their firearms for lowest recoil and twist by measuring the peak recoil and twisting motion of the firearm.

The sensor system presently disclosed may operate in standalone mode to log the shooter's performance and also track the cyclic rate of the bolt carrier group on semiautomatic/automatic firearms. Tracking of the bolt cyclic rate allows the sensor system presently disclosed to determine when the semiautomatic/automatic firearm has become dirty and requires maintenance. Tracking of the bolt cyclic rate may allow the sensor system presently disclosed to be used with accessories that control the gas block of semiautomatic/automatic firearms and to regulate the gas system of such firearms.

The sensor system presently disclosed may comprise one or more ports to communicate with Windows, IOS and/or Android operating systems as a firearm attached motion tracking device for virtual and augmented reality. The sensor system presently disclosed may comprise a 9-axis motion sensors for detecting movement which maps to quaternions in 3D.

Figure 1:
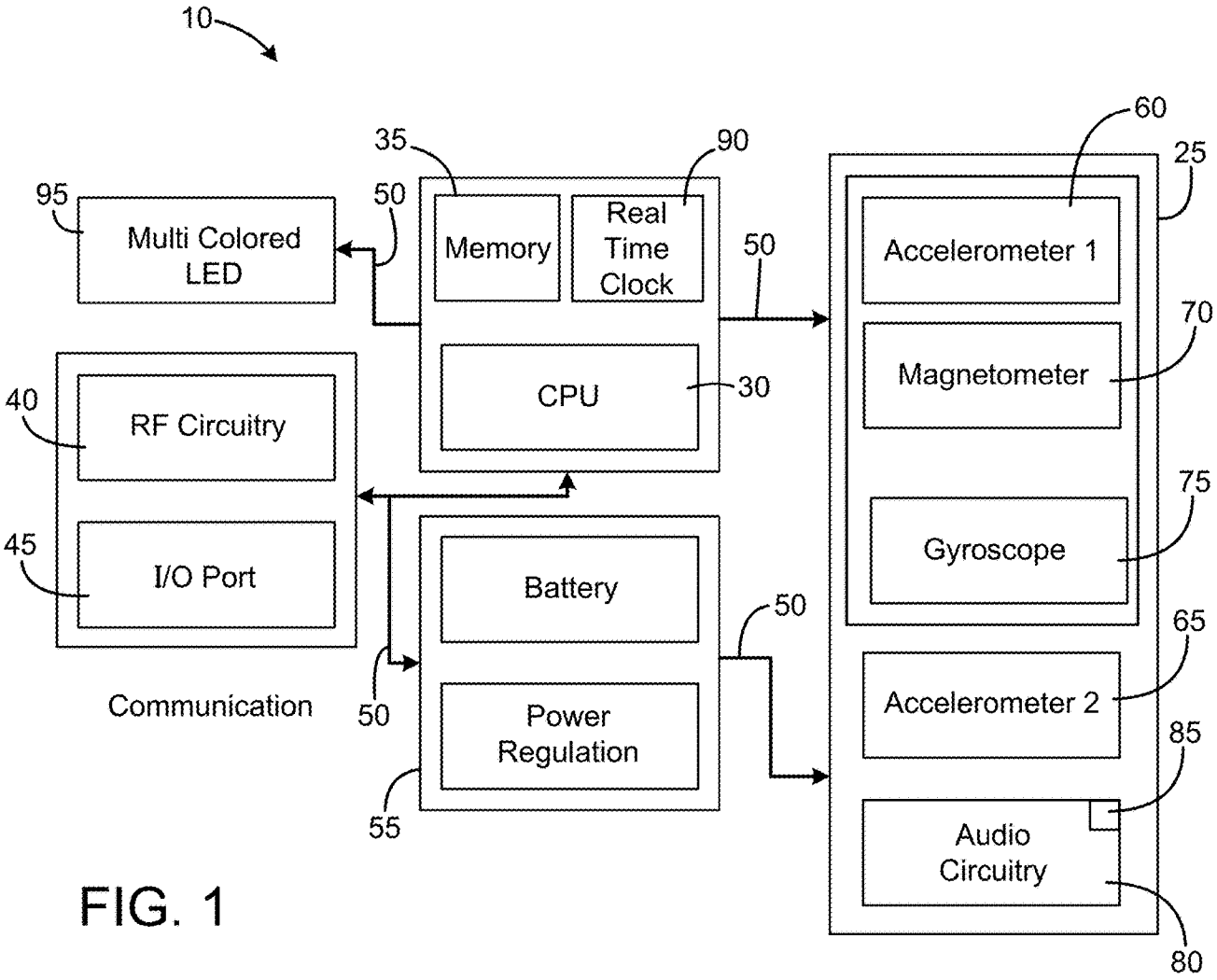
FIG. 1 depicts a block diagram of the sensor system according to the present disclosure.

A sensor system 10 presently disclosed may comprise a sensor hub 25, one or more processing units (CPUs) 30, a memory 35 (which may comprise one or more computer readable storage mediums) as shown in FIG. 1. These components may communicate over one or more communication buses or signal lines 50.

The memory 35 may comprise high-speed random access memory and/or non-volatile memory, such as one or more magnetic disk storage devices, flash memory devices, or other non-volatile solid-state memory devices. The memory 35 may be configured to store an operating system. The operating system comprises various software components and/or drivers for controlling and managing general system tasks (e.g., memory management, storage device control, power management, etc.) and facilitates communication between various hardware and software components of the sensor system 10.

The sensor system 10 presently disclosed may further comprise a radio frequency (RF) circuitry 40. The RF circuitry 40 may be configured to receive and transmit RF signals, also called electromagnetic signals. The RF circuitry 40 converts electrical signals to/from electromagnetic signals and communicates with communications networks and other communications devices via the electromagnetic signals. The RF circuitry 40 may include well-known circuitry for performing these functions, including but not limited to an antenna system, an RF transceiver, one or more amplifiers, a tuner, one or more oscillators, a digital signal processor, a CODEC chipset, a subscriber identity module (SIM) card, memory, and so forth. The RF circuitry 40 may communicate with networks, such as the Internet, also referred to as the World Wide Web (WWW), an intranet and/or a wireless network, such as a cellular telephone network, a wireless local area network (LAN) and/or a metropolitan area network (MAN), and other devices by wireless communication. The wireless communication may use any of a plurality of communications standards, protocols and technologies, including but not limited to Global System for Mobile Communications (GSM), Enhanced Data GSM Environment (EDGE), high-speed downlink packet access (HSDPA), wideband code division multiple access (W-CDMA), code division multiple access (CDMA), time division multiple access (TDMA), Bluetooth, Wireless Fidelity (Wi-Fi) (e.g., IEEE 802.11a, IEEE 802.11b, IEEE 802.11g and/or IEEE 802.11n), voice over Internet Protocol (VoIP), Wi-MAX, a protocol for email (e.g., Internet message access protocol (IMAP) and/or post office protocol (POP)), instant messaging (e.g., extensible messaging and presence protocol (XMPP), Session Initiation Protocol for Instant Messaging and Presence Leveraging Extensions (SIMPLE), and/or Instant Messaging and Presence Service (IMPS)), and/or Short Message Service (SMS)), or any other suitable communication protocol, including communication protocols not yet developed as of the filing date of this document. The memory 35 may comprise various software components for handling data received by the RF circuitry 40.

The sensor system 10 presently disclosed may also comprises one or more input/output (I/O) ports 45. The I/O ports 45 are configured to couple one or more external devices to the sensor system 10. The memory 35 may be configured to store a communication module to facilitate communication between the sensor system 10 and other devices over the one or more external ports 45. The I/O port 45 (e.g., Universal Serial Bus (USB), FIREWIRE, etc.) may be configured for coupling directly to other devices or indirectly over a network (e.g., the Internet, wireless LAN, etc.). The I/O port 45 may be used to couple one or more temperature sensors, a laser, a camera, a trigger switch, and/or flashlight to the sensor system 10. The memory 35 may comprise various software components for handling data received and/or transmitted by the I/O port 45.

The CPU 30 may be able to check for the assigned identification (ID) code of any accessory connected via the I/O port 45 to the sensor system 10. The assigned ID code may be used to determine the overall dimension of the system. The ID code may be used to check for authorized accessories and configure the I/O port 45 to reject unauthorized accessories. The memory 35 may be configured to store one or more ID codes of the authorized accessories. The CPU 30 may compare the ID code of the accessory connected via the I/O port 45 to the one or more ID codes stored in the memory 35 to determine if the accessory is authorized to be connected with the sensor system 10.

The sensor system 10 presently disclosed may comprise a power system 55 for powering the various components of the sensor system 10. The power system 55 may comprise a power management system, one or more power sources (e.g., battery, alternating current (AC)), a recharging system, a power failure detection circuit, a power converter or inverter, a power status indicator (e.g., a light-emitting diode (LED)) and/or any other components associated with the generation, management and distribution of power in portable devices. The I/O port 45 may be configured to deliver power to the power system 55. The I/O port 45 may be configured to deliver power from the power system 55 to at least one external device. The I/O port 45 may be configured to deliver power from the power system 55 to a camera for visual recording of shots, a flashlight, a laser, a temperature sensor, etc. The I/O port 45 may be used to re-program the power system 55 with different power algorithms to accommodate power requirement of different accessories.

The sensor hub 25 may comprise a first accelerometer 60 and a second accelerometer 65. The sensor hub 25 may further comprise a magnetometer 70. The sensor hub 25 may also comprise a gyroscope 75. The sensor hub 25 may comprise an audio circuitry 80.

The audio circuitry 80 may comprise a microphone 85 to receive sound waves generated by the firearm and to convert the sound waves to electrical signals (i.e. acoustic signal). The audio circuitry 80 may convert the electrical signal to audio data and transmits the audio data to CPU 30 for processing. The audio data may be retrieved from and/or stored to the memory 35. The sensor system 10 may determine dry fires of the firearm by the sound waves received by the microphone 85. The sensor system 10 may determine live fires of the firearm by the sound waves received by the microphone 85.

The microphone 85 may receive voice commands generated by the user of the firearm and the audio circuitry 80 converts the voice commands to electrical signals (i.e. acoustic signal). The audio circuitry 80 may convert the electrical signal to audio data and transmit the audio data to CPU 30 for processing. The audio data may be retrieved from and/or stored to the memory 35.

Figure 8:
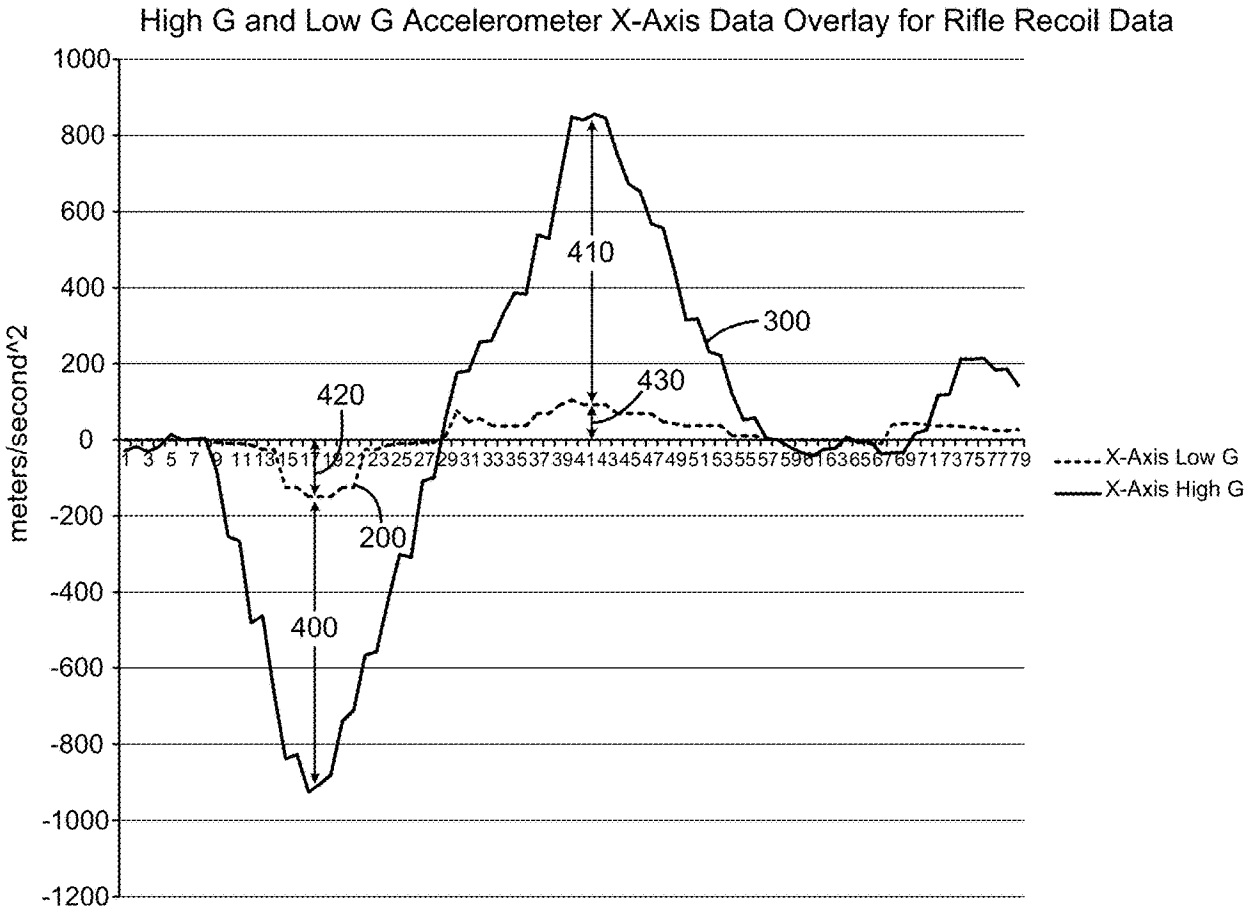
FIG. 8 depicts accelerometer data in the X-axis according to the present disclosure.
Figure 9:
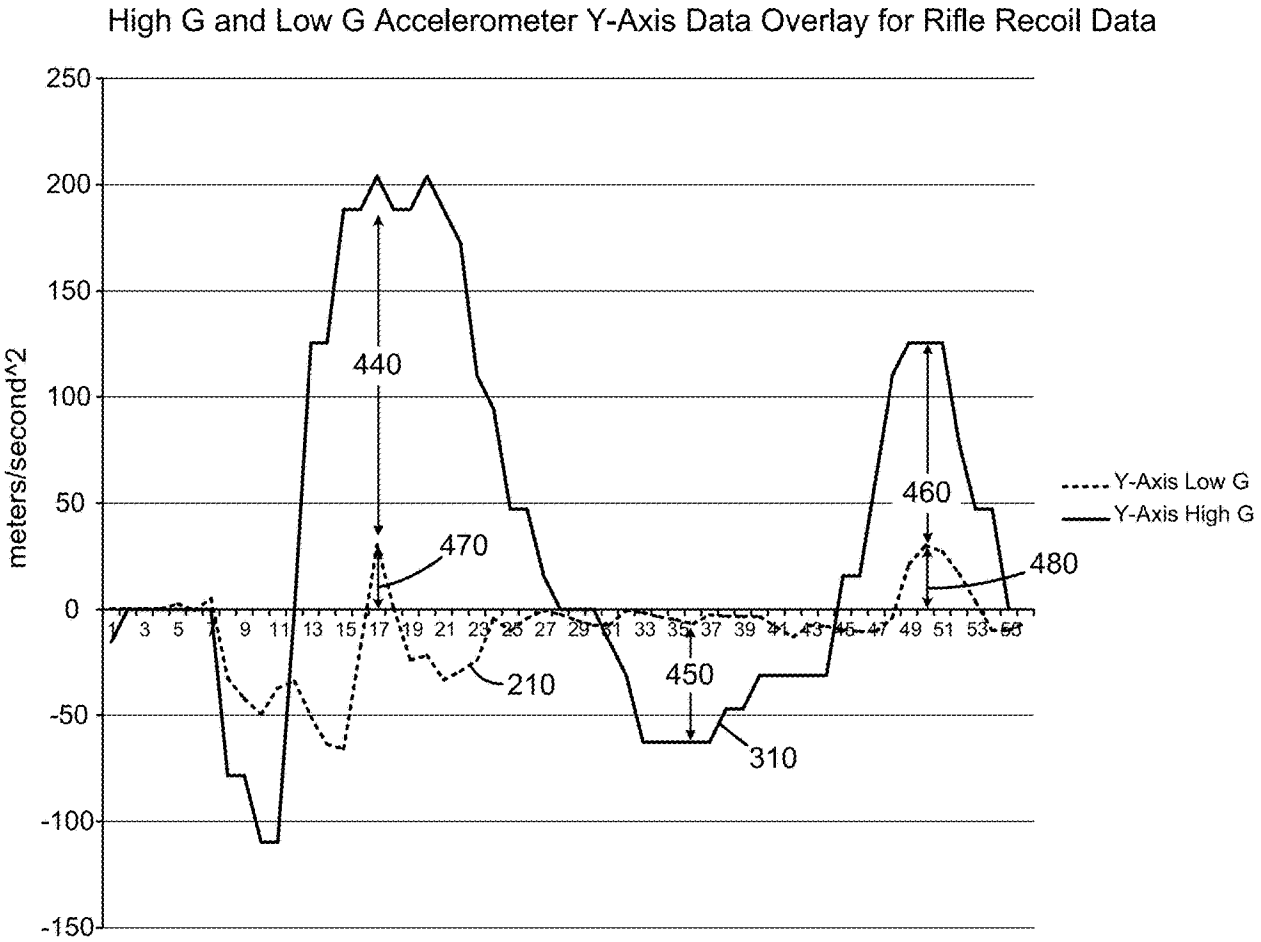
FIG. 9 depicts accelerometer data in the Y-axis according to the present disclosure.
Figure 10:
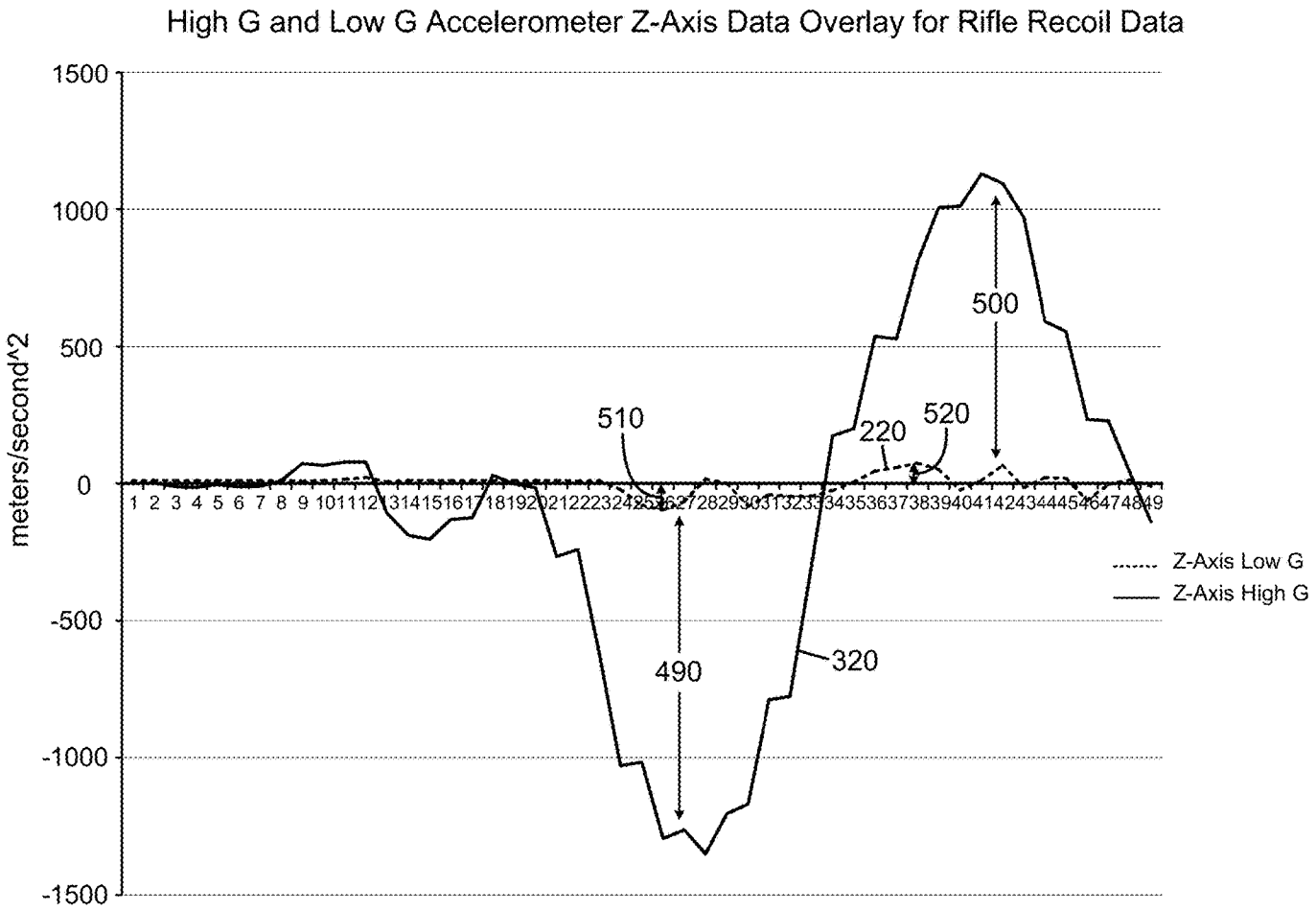
FIG. 10 depicts accelerometer data in the Z-axis according to the present disclosure.

The first accelerometer 60 may be able to detect a movement including an acceleration and/or de-acceleration of the sensor system 10. The first accelerometer 60 may generate movement data for multiple dimensions, which may be used to determine a moving direction of the sensor system 10. For example, the first accelerometer 60 may generate X, Y, and Z axis (i.e. 3-axis) acceleration information when the first accelerometer 60 detects that the sensor system 10 is moved. The first accelerometer 60 may be configured to detect G-force within a first range. The first range may be substantially between −16G (−156 m/s2) and +16G (+156 m/s2) as shown in FIGS. 8-10. Referring to FIG. 8, the acceleration measured by the first accelerometer 60 in the X-axis is marked by reference number 200. Referring to FIG. 9, the acceleration measured by the first accelerometer 60 in the Y-axis is marked by reference number 210. Referring to FIG. 10, the acceleration measured by the first accelerometer 60 in the Z-axis is marked by reference number 220.

The first accelerometer 60 may be configured to detect subtle movements that occur before the pull of the firearm's trigger and the movement as the firearm returns to battery after the recoil has been absorbed. The system 10 may be able to determine dry fires of the firearm by the movements sensed by the first accelerometer 60. The sensor system 10 may be able to determine dry fires of the firearm by the movements sensed by the first accelerometer 60 and sound waves collected by the microphone 85.

The second accelerometer 65 may also be able to detect a movement including an acceleration and/or de-acceleration of the sensor system 10. The second accelerometer 65 may generate movement data for multiple dimensions, which may be used to determine a moving direction of the sensor system 10. For example, the second accelerometer 65 may generate X, Y, and Z axis (i.e. 3-axis) acceleration information when the second accelerometer 65 detects that the sensor system 10 is moved. The second accelerometer 65 may be configured to detect G-force within a second range. The second range may be substantially between −200G (−1960 m/s2) and +200G (+1960 m/s2) as shown in FIGS. 8-10. Referring to FIG. 8, the acceleration measured by the second accelerometer 65 in the X-axis is marked by reference number 300. Referring to FIG. 9, the acceleration measured by the second accelerometer 65 in the Y-axis is marked by reference number 310. Referring to FIG. 10, the acceleration measured by the second accelerometer 65 in the Z-axis is marked by reference number 320.

The second accelerometer 65 may be configured to detect high G-shocks movements caused by, for example, recoil from the firing of the firearm. The sensor system 10 may be able to determine live fire of the firearm from the movements senses by the second accelerometer 65. The sensor system 10 may be able to determine live fire of the firearm from the combination of movements senses by the second accelerometer 65 and sound waves collected by the microphone 85.

As shown in FIG. 8, reference numbers 400 and 410 represent portions of the first range and portions of the second range that do not overlap in the X-axis. As shown in FIG. 8, reference numbers 420 and 430 represent portions of the first range and portions of the second range that overlap in the X-axis.

As shown in FIG. 9, reference numbers 440, 450 and 460 represent portions of the first range and portions of the second range that do not overlap in the Y-axis. As shown in FIG. 9, reference numbers 470 and 480 represent portions of the first range and portions of the second range that overlap in the Y-axis.

As shown in FIG. 10, reference numbers 490 and 500 represent portions of the first range and portions of the second range that do not overlap in the Z-axis. As shown in FIG. 10, reference numbers 510 and 520 represent portions of the first range and portions of the second range that overlap in the Z-axis.

The sensor system 10 may be able to determine firearm's operational actions such as, for example, the slide of the firearm being racked, the magazine of the firearm being ejected, and the magazine of the firearm being inserted. The sensor system 10 may be able to determine firearm's operational action using sound waves collected by the microphone 85. The sensor system 10 may be able to determine firearm's operational action using sound waves collected by the microphone 85 in combination with movements sensed by the first accelerometer 60 and/or the second accelerometer 65.

The gyroscope 75 may be configured to measure angular rotational velocity of the sensor system 10. The gyroscope 75 is a 3 axis gyroscope. The gyroscope 75 may be used to measure how much the firearm twists upon the firing of a round. This information can be used by gun tuners who adjust the angle of direction muzzle brakes to minimize twist.

The magnetometer 70 may measure direction the firearm is pointed. The magnetometer allows the sensor system 10 to determine the firearm's orientation. This data is useful for positional algorithms and for calculating the proper corrections in extended long range shooting applications. The magnetometer 70 may be a 3-axis magnetometer.

The sensor system 10 may comprise a time clock 90 to determine and record time. The CPU 30 may be able to log, timestamp and analyze the information collected from the first accelerometer 60, the second accelerometer 65, the gyroscope 75, the time clock 90 and/or the microphone 85. The CPU 30 may be able to run one or more algorithms to convert time stamped measurements obtained from the first accelerometer 60, the second accelerometer 65, the gyroscope 75, the time clock 90 and/or the microphone 85 into time stamped vectors or events that can be provided to other devices.

The CPU 30 may perform a sensor fusion algorithm on the data collected by the first accelerometer 60, the second accelerometer 65 and/or magnetometer 70 to generate quaternions. The sensor fusion algorithms may use 9-axis data from the 3-axis first accelerometer 60, the 3-axis gyroscope 75, and the 3-axis magnetometer 70.

The CPU 30 may perform an impulsive sensor fusion algorithm using the data collected from the second accelerometer 65 to model the high speed movement of the sensor system 10 under recoil for proprietary 12-axis sensor fusion. The impulsive sensor fusion may use the 3-axis data from the second accelerometer 65 to model the high speed movement of the sensor system 10.

The sensor system 10 may be able to run 6, 9, and 12-axis sensor fusion to compute rotational and game rotational vectors that may be used for virtual and augmented reality motion control. The sensor system 10 may be programmed with different fusion algorithms for different data analysis.

The data measured and/or generated by the first accelerometer 60, the second accelerometer 65, the gyroscope 75, audio circuitry 80 and/or magnetometer 70 may be stored in the memory 35. The data measured and/or generated by the first accelerometer 60, the second accelerometer 65, the gyroscope 75, audio circuitry 80 and/or magnetometer 70 may be transmitted to another device using the RF circuitry 40. The data measured and/or generated by the first accelerometer 60, the second accelerometer 65, the gyroscope 75, audio circuitry 80 and/or magnetometer 70 may be transmitted to a smart phone, tablet, or a computing device using the RF circuitry 40.

The CPU 30 may comprise one or more Application Program Interface (API) extensions to allow third party developers access to the data collected by the sensor system 10 to create games and/or training applications. The API extensions may allow third party users to develop applications that can run on Android and IOS phones, tablets, and set top boxes.

The sensor system 10 may work as a standard Human Interface Device (HID) such as a wireless air mouse for regular applications. The wireless air mouse mode may be a default mode when the sensor system 10 connects to cellphones/tablets/computer unless set to a different default mode in software.

The HID interface may be switched to the rotation vector or game rotation vector mode via the API to fit the virtual reality or augmented reality applications that may need and/or support it. These vectors may be derived using the CPU 30 or may be derived using an external CPU. The custom rotation vector algorithms may accommodate extremely high sampling rates (>1 KHz) and/or incorporate the data from the second accelerometer 65 for 12-axis operation for high speed, high shock movements.

The sensor system 10 may be accessed by an app running on a smartphone, tablet and/or computing device for real time analysis and/or aggregated multi-shot analysis. The sensor system 10 may be accessed through the RF circuitry 40. The CPU 30 may provide simple shot by shot feedback via color of a multicolored LED 95. Users may be able to analyze single shots in both dry fire and live fire as well as multiple rapid fire shots in live fire activities using the LED 95 and/or the app running on a computing device.

Different colors of the multicolored LED 95 may also be used to show successful RF circuitry pairing, power status, good shot placement, and/or bad shot placement.

Figure 2:
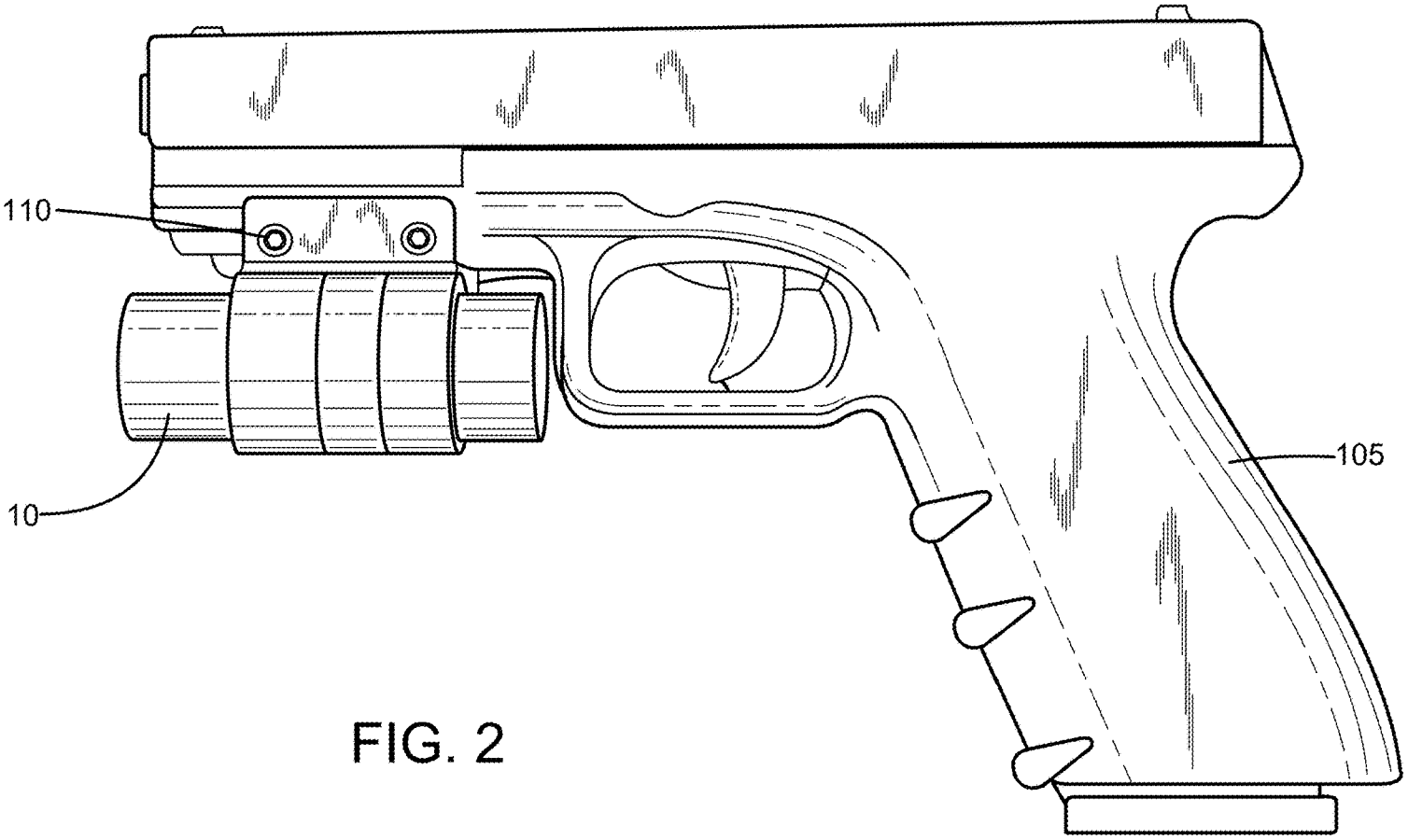
FIG. 2 depicts the sensor system according to the present disclosure mounted on a handgun.
Figure 3:
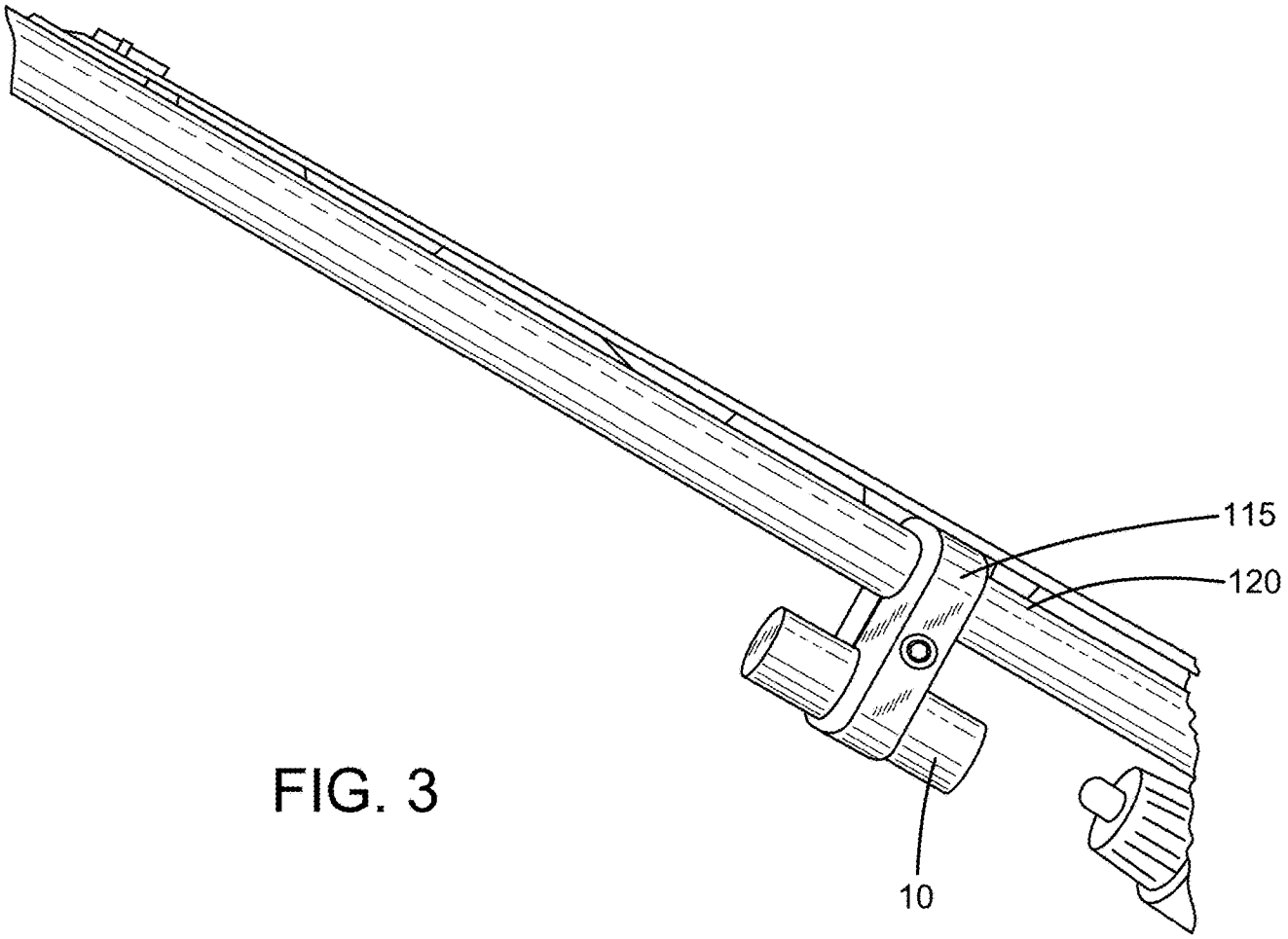
FIG. 3 depicts the sensor system according to the present disclosure mounted on a rifle.

Referring to FIG. 2, the sensor system 10 presently disclosed may be coupled with a handgun 105. The body 100 may be coupled to the handgun 105 using mounting facility 110. Referring to FIG. 3, the sensor system 10 presently disclosed may be coupled with a riffle 120. The body 100 may be coupled to the rifle 120 using mounting facility 115.

Figure 4:
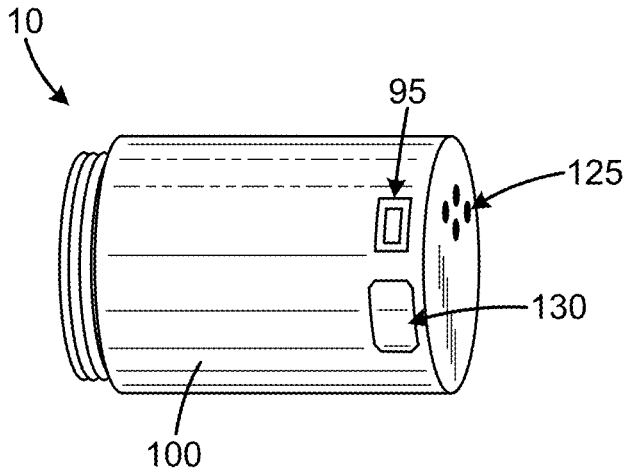
FIG. 4 depicts an external perspective view of the sensor system according to the present disclosure.

Referring to FIG. 4, the sensor system 10 comprises a body 100. The body 100 may comprise openings 125 to allow sound waves to reach the microphone 85 located inside the housing 100. The body 100 may comprise a push button 130 to turn on/off the sensor system 10. The push button 130 may be used to connect the RF circuitry 40 of the sensor system 10 to an external device(s). The push button 130 may be waterproof.

Figure 5:
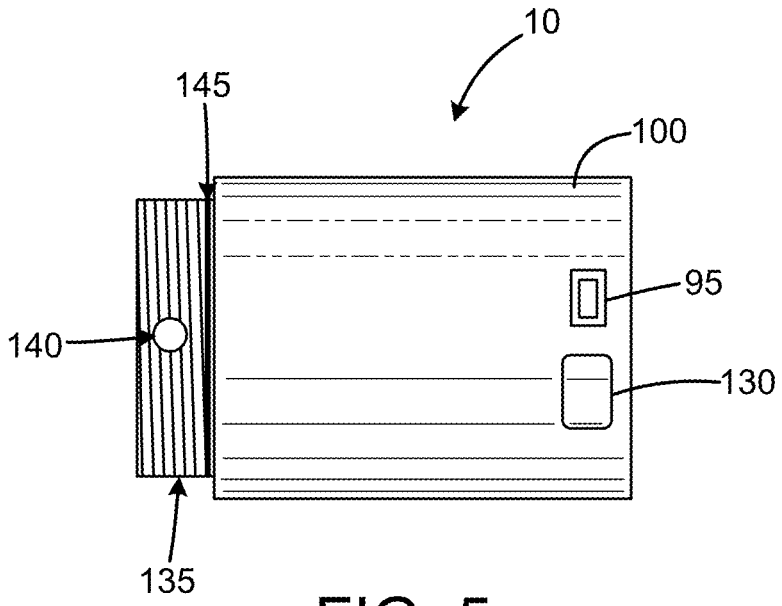
FIG. 5 depicts an external side view of the sensor system according to the present disclosure.

Referring to FIG. 5, the body 100 may further comprise a screw thread 135 to allow attachment of an accessory to the body 100. The body 100 may comprise one or more screw indentations 140 used to index pins and lock the accessory to the body 100. The body 100 may comprise a rubber O-ring 145 to create waterproof seal between the body 100 and the accessory.

Figure 6:
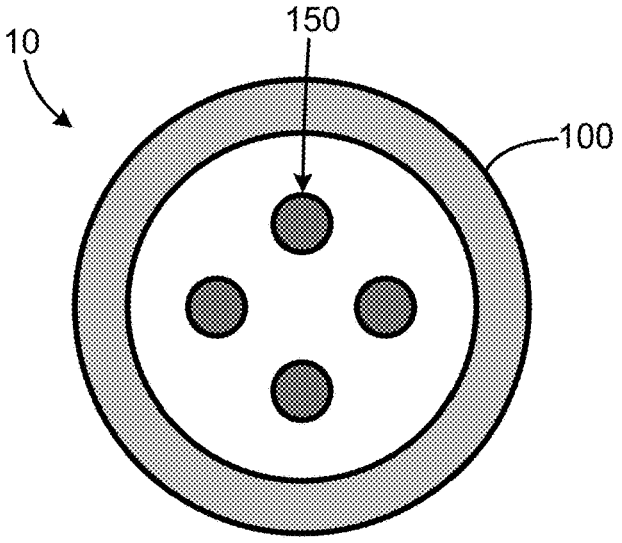
FIG. 6 depicts a view of a connector on the sensor system according to the present disclosure.

Referring to FIG. 6, the body 100 may comprise an opening 150 to allow access to the I/O port 45 and to allow power and/or data to be transmitted between the sensor system 10 and the accessory.

Figure 7:
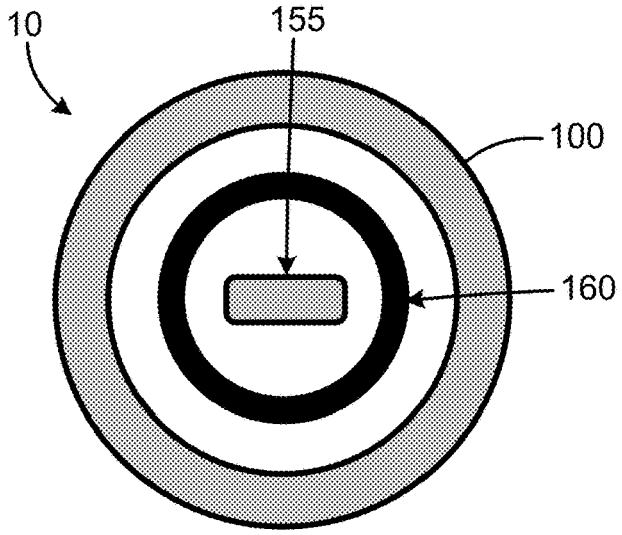
FIG. 7 depicts a view of another connector on the sensor system according to the present disclosure.

Referring to FIG. 7, the body 100 may comprise another type of opening 155 to allow access to the I/O port 45 and to allow power and/or data to be transmitted between the sensor system 10 and the accessory. The body 100 may comprise an O-ring 160 to create waterproof seal between the body 100 and the accessory.

The sensor system 10 may use LED 95 to transmit and receive data using Light Fidelity (Li-Fi) technology. Li-Fi technology is a bidirectional, high speed wireless communication technology used to transmit data.

The body 100 may be about 1.5" to 2.5" in length and about 1" in diameter.

The sensor system 10 as shown in FIG. 1 may comprise more or fewer components than shown, may combine two or more components, or a may have a different configuration or arrangement of the components. The various components shown in FIG. 1 may be implemented in hardware, software or a combination of both hardware and software, including one or more signal processing and/or application specific integrated circuits. Components of the sensor system 10 may be implemented on a single chip. Components of the sensor system 10 may be implemented on separate chips.

I claim:

1. A sensor system for a firearm comprising:

a body;

a mounting facility adapted to mount the body to the firearm;

a first accelerometer connected to the body operable to generate a first acceleration signal based on detected acceleration of the body;

a second accelerometer connected to the body in a fixed relationship with the first accelerometer, and operable to generate a second acceleration signal based on detected acceleration of the body;

the first accelerometer operable for detection of accelerations within a first range between a first lower limit and a first upper limit;

the second accelerometer operable for detection of accelerations within a second range between a second lower limit and a second upper limit;

the first lower limit being less than the second lower limit; and the first upper limit being less than the second upper limit, such that at least portions of the first range and the second range do not overlap.

2. The sensor system of claim 1 wherein each of the first and second accelerometers includes three accelerometer elements, each associated with a perpendicular axis.

3. The sensor system of claim 1 wherein only a minor portion of the first range overlaps with the second range.

4. The sensor system of claim 1 further comprising a processor operably connected to the first and second accelerometers and operable to receive the first and second accelerations signals and to generate a resulting acceleration signal based on the first and second accelerations signals.

5. The sensor system of claim 1 wherein the first range includes accelerations associated with motions associated with trigger operation before discharge of the firearm, and wherein the second range includes accelerations associated with motions associated with recoil due to discharge of the firearm.

6. The sensor system of claim 1 further comprising a gyroscopic sensor operable to detect rotational movement of the body and generate a rotational signal.

7. The sensor system of claim 1 further comprising a microphone.

8. The sensor system of claim 7 further comprising a processor operably connected to the first and second accelerometers and to the microphone, and operable to determine whether an acoustic event detected by the microphone is correlated with an acceleration event detected by at least one of the first and second accelerometers.

9. The sensor system of claim 8 further comprising determining whether a discharge occurred in response to a trigger pull based on whether an acceleration event occurred during an acoustic event.

10. The sensor system of claim 7 including a processor operably connected to the first accelerometer and to the microphone, and operable to determine whether an acoustic event detected by the microphone is correlated with an acceleration event detected by the first accelerometer.

11. The sensor system of claim 10 including determining whether a discharge occurred in response to a trigger pull based on whether an acceleration event occurred during an acoustic event.

12. The sensor system of claim 3 wherein only a minor portion of the second range overlaps with the first range.

13. The sensor system of claim 1 wherein the first range is an order of magnitude less than the second range.

14. The sensor system of claim 1 wherein the first range is less than 10% of the second range.

* * * * *